United States Patent [19]

Hoffmann

[11] Patent Number: 4,735,366

[45] Date of Patent: Apr. 5, 1988

[54] ANNULAR GAP-TYPE MILL

[76] Inventor: Karl H. Hoffmann, Ückinghovener Strasse 71, D-4049 Rommerskirchen 1, Fed. Rep. of Germany

[21] Appl. No.: 917,979

[22] Filed: Oct. 14, 1986

[30] Foreign Application Priority Data

Oct. 12, 1985 [DE] Fed. Rep. of Germany ..... 3536440

[51] Int. Cl.[4] ..... B02C 17/16

[52] U.S. Cl. ..... 241/36; 241/37; 241/46 B; 241/46.17; 241/172; 241/180

[58] Field of Search ..... 241/172, 46.17, 46 B, 241/179, 180, 2, 1, 65, 66, 67, 36, 37

[56] References Cited

U.S. PATENT DOCUMENTS

| | | | |
|---|---|---|---|
| 2,738,172 | 3/1956 | Spiess et al. | 241/1 X |
| 3,199,792 | 8/1965 | Norris, Jr. | 241/179 X |
| 4,225,092 | 9/1980 | Matter et al. | 241/46 B |
| 4,304,362 | 12/1981 | Buhler | 241/180 X |

FOREIGN PATENT DOCUMENTS

| | | |
|---|---|---|
| 2811899 | 9/1979 | Fed. Rep. of Germany . |
| 2131721 | 6/1984 | United Kingdom . |

*Primary Examiner*—Mark Rosenbaum

*Attorney, Agent, or Firm*—Spensley Horn Jubas & Lubitz

[57] ABSTRACT

An annular gap-type mill for continuously pulverizing in particular hard mineral substances comprises a grinding container (15) which accommodates an axially symmetrical inner body (13) whose outer surface defines with the inner surface of the grinding container (15) a grindimg gap (23). It is essential that the upper and lower region of the inner body (13) are tapered in opposite directions and adjoined to a common equatorial zone (24) of maxi diameter and that the outer surface of at least one of the regions is curved convexly. The grinding container (15) and/or the inner body (13) may be driven rotatingly. The annular gap-type mill is suited for wet and dry grinding and its quantitative and qualitative output is high.

27 Claims, 7 Drawing Sheets

ANNULAR GAP-TYPE MILL

Figure 1:
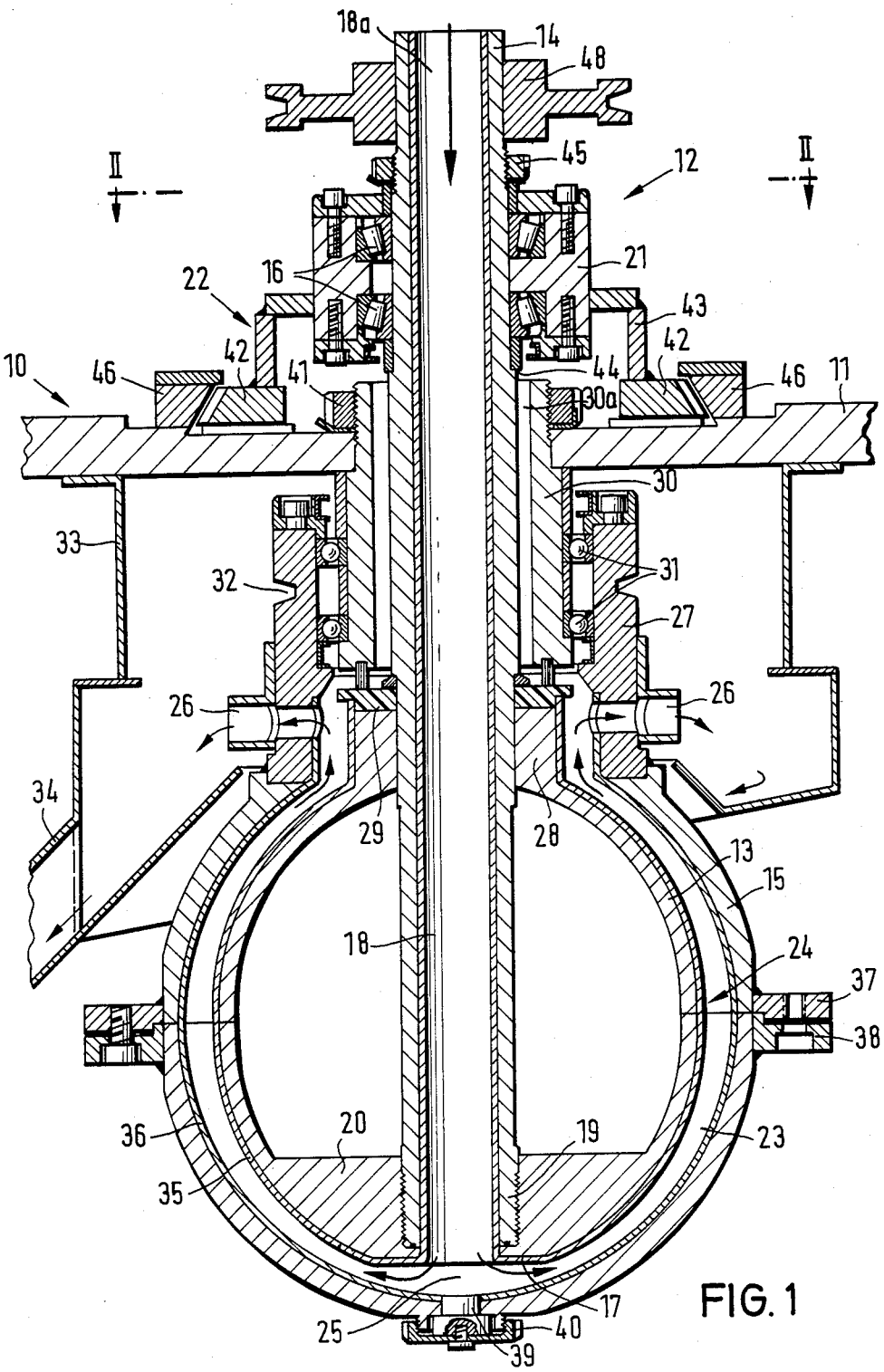

The invention relates to an annular gap-type mill for continuously pulverizing in particular hard mineral substances comprising an outer grinding container accomodating an axially symmetrical inner body whose outer surface defines with the inner surface of the grinding container a grinding gap.

Hard mineral substances (Mohs'hardness>5) such as corundum, circonium dioxide, alumina, silicon carbide and similar substances have been pulverized predominantly hitherto by iron balls in ball mills. Considerable residence times of the material in the grinding chamber are involved therewith and all of the elements contacting the grinding stock and the iron balls are exposed to a very strong wear. Further, the noise developing with the grinding operation is very disturbing. Moreover, as an additionala disadvantage of such ball mills, the abrasion of the iron balls which gets into the grinding material must be washed out by complicated expensive means with the use of chemical processes.

Annular gap-type mills of the above mentioned type comprising a cylindrical or frustoconical, straight-face, rotatable inner rotor (U.S. Pat. No. 4,225,092) are supposed to incorporate an improvement over conventional ball mills. However, they are less suited for pulverizing hard mineral substances, and they are only economic in view of the comminution of considerably softer substances such as chalk and the like. This is particularly due to the behaviour of the grinding balls or grinding pellets in the grinding gap. While the grinding pellets pumped together with the grinding stock (slurry) from below into the grinding gap first are moved up in the latter by the pressure of the feed pump by which the grinding stock suspension is pressed into the annular gap-type mill, and by the rotational movement of the rotor, they sink down by gravity with decreasing pump pressure thus excluding a grinding operation in the upper part of the grinding gap. This may be avoided by increasing the feed pump pressure or the flow of the grinding stock to such an extent that the grinding pellets are held in the upper portion of the grinding gap. This involves the risk for the grinding pellets to be discharged together with the grinding stock, thus causing a reduction of the grinding output. Experience has shown that with an average flow rate of the grinding material, only the lower half of the grinding gap is more or less fully utilized for the grinding operation while the grinding output obtainable theoretically is only half-realised. Further, the high packing density of the grinding pellets in the lower part of the grinding gap causes a high wear of the surface of the rotor and of the grinding container. The rotor may be even blocked, in particular after a short rest period of the inner rotor or of the feed pump. Said risk shall be reduced in case of the foregoing annular gap-type mills in that the lower end of the rotor is provided with an impeller which, however, only will intensify another disadvantage of the annular gap-type mill to the effect that the grinding pellets which do not sink down are increasingly pumped together with the grinding stock to the discharge opening and thus are lost for the grinding operation. Moreover, the impeller is exposed to high wear caused by grinding pellets and grinding stock. Sometimes, screens are used to retain the grinding pellets in the grinding gap; however, they inhibit the discharge of the grinding material such has to even stop it if they are clogged by grinding stock and grinding pellets.

According to another known annular gap-type mill (German laid-open print No. 28 11 899), a cone ring-shaped grinding stock container is used whose inner face confines with a cone ring-shaped rotatable displacement body a grinding chamber. In an annular plate carrying the displacement body, return channels for the grinding pellets are fitted to extend obliquely to the outside. Also in this case, said grinding pellets show the mentioned unfavorable behaviour, and, in spite of the circulation of the grinding pellets, the total height of both grinding gap portions practically is not used for the grinding operation. The grinding pellets present in the inner down-feed grinding gap portion are following rather than counteracting the grinding stock flow in discharge direction so that the operation performed in this part of the grinding gap is even less effective than in the other portion thereof in which gravity may cause a certain longer residence time. In a probable other embodiment, the grinding container may be adapted to be driven rotatably about the center axis. However this measure does not entail any advantages concerning an optimization of the degree of comminution, but, on the contrary, the grinding pellets are driven more quickly through the grinding gap down the inside and up the outside so that, by their shorter residence time in the grinding gap, the grinding effect is decreased. Besides, this known annular gap-type mill is only suited for wet grinding, while dry material may not be treated therewith at all.

The prior filed but not yet published U.S. patent application Ser. No. 766,111 offers a certain remedy in that the rotatable inner rotor and the stationary grinding container comprise a frustoconical, straight-faced lower part and an oppositely tapered, frustoconical, straight-faced upper part which include, within the range of the lower parts a grinding gap, and, within the range of the upper parts, an outlet cap whose lower end of maximum diameter ends in an annular chamber at the open upper end of maximum diameter of the grinding gap. Due to the annular chamber, a reduction of the amount of grinding pellets or of the grinding effect is avoided in that a predetermined grinding pellet surplus received by the chamber is adapted to form there a floating barrier layer to withold the active grinding pellets in the grinding gap. While the total grinding gap height is utilized this way in favor of the active grinding operation of the grinding pellets, which are prevented from sinking down in the grinding gap by hydrodynamics and centrifugal force, the height of the grinding gap is restricted to the lower part of rotor and grinding container thus resulting in an undesired decline of output. Further, said advantageous hydrodynamic effect is only inherent to wet grinding but not to the dry grinding operations which, however, is just frequently desirable in case of hard mineral substances, because their pulverized powders shall be further processed in dry so that wet grinding (with subsequent drying and disagglomeration) implies an energetic detour.

Therefore, it is the object of the invention to improve an annular gap-type ball mill of the above mentioned type so that, by an increased effectivity in the grinding gap, an economically and technically perfect pulverization of hard mineral substances in wet and in dry conditions is possible.

The problem is solved according to the invention in that the upper and lower region of the inner body are tapered in opposite directions and adjoined to a common equatorial zone of maximum diameter, the outer surface of at least one of the regions being curved convexly.

Tests have shown that axially symmetrical bodies of the above mentioned shape allow to realise a relative optimum of the total of all requirements to be met in case of the performance of an annular gap-type mill: high ball filling degree in the grinding gap, high feed rate of grinding stock through the ball packing, high power receptivity of the balls from the driving source with a resultant high shearing effect of the balls from the qualitative (grinding fineness) and quantitative (grinding stock amount) viewpoint, no discharge of grinding balls by the flow (or transport) of the grinding stocks, said requirements being applicable to wet and to dry grinding operations as well.

The mill of the instant invention will comply with said requirements, it being also possible to determine the mill character by the selected drive, as follows:

If the mill is to operate in wet, the inner body (as a rotor) is to be driven; a hydrodynamic effect which then develops in the grinding gap acts, as a consequence of the oppositely tapered upper and lower regions of inner body and grinding container and of the convex curvature of at least one of the regions, against the gravity of the grinding pellets and of the grinding stock thus inhibiting their sinking in the grinding gap while due to the centrifugal force in the region of the maxi diameter, the grinding pellets are not discharged with the grinding stock. Hence, a separation of grinding stock and grinding pellets is achieved without the use of screens. The rising speed of the grinding stock in the grinding gap being dependent, on the one hand, on the speed of the inner body, the grinding effect may be influenced by the speed control. Thus, by avoiding the discharge of grinding pellets, the grinding effect may be varied and the desired fineness may be adjusted. The residence time of the slurry in the grinding gap is dictated, on the other hand, by the grinding stock delivery rate which may be controlled by the feed pump so that, by influencing this parameter, the grinding effect is changeable in the desired manner. If the operation is performed at high peripheral speeds of the inner body, but at a low feed pump output, the grinding stock slowly moves upward towards the discharge end by the rotatingly driven grinding pellet ring, and, due to the long residence time, the grain spectrum of the slurry is close.

If the mill is operated in dry, the grinding container is to be driven (as an outer rotor). The grinding pellets and grinding stock particles present in the grinding gap are subjected to the centrifugal force which, as a consequence of the oppositely tapered upper and lower regions of inner body and grinding container and by the convex curvature of at least one of the regions, counteracts the gravity of the grinding balls and grinding stock particles thus preventing them from sinking down in the grinding gap, on the one hand, and avoiding the discharge of grinding pellets by the grinding stock particles, on the other hand. Besides, in dry grinding, the possibilities of control of the grinding process are basically the same as in case of wet grinding. The slurry feed pump may be replaced by an air current feed.

In case of both embodiments, the convex curvature of one region of the mill cross section tapered in opposite directions may be supplemented by a second convexly curved region or a conical, straight faced zone. Advantageously, a convex lower region may be combined with an upper region shaped concavely at least in part. Due to the concavity of the upper region of the cross section, the grinding pellets are hindered from drifting upwardly.

It is favorable for the outer surface of the inner body to be spherically curved in a closed line. The inner face of the grinding container is correspondingly curved spherically, thus resulting in the formation of a ball cup-shaped grinding gap whose upper end, preferably beyond the inner body, is provided with the outlet for the ground material. Preferably, material to be ground is fed in the lower apex bottom of the grinding gap. The outer surface of the inner body and the inner face of the grinding container may be designed as an ellipsoid or hyperbolic body or the like. The shape of the outer surface of the inner body and of the inner face of the grinding container need not be identical. It is possible, for instance, to combine an elliptic inner body or a spherical inner body being somewhat flattened in the equatorial zone of maxi diameter with an absolutely spherical inner face of a grinding container. Due to such a variety of radii of the curvatures of the outer surface of the inner body and of the inner surface of the grinding container, in particular in the equatorial zone, the retention of grinding pellets in the equatorial zone is favored and the grinding operation is intensified because of the higher forces prevailing there.

The central axis of the inner body may be inclined relative to that of the grinding container. Since, in operation of the mill, particles richest in mass, viz. the grinding pellets, as a rule, move on an orbit extending at right angles to the central axis of the driven mill component (inner body or grinding container), this will mean that, subject to the inclination of inner body or grinding container, the outlet may be transferred to the highest or lowermost point of the grinding gap. Said distance of the material outlet to the equitorial zone as the most operative region of the driven mill component additionally contributes to hinder a discharge of grinding pellets.

Suitably, the inner body or grinding container may be supported displaceably thus allowing to change the grinding gap width. The displacement is performed substantially transversely to the central axis of the inner body which is situated eccentrically in the grinding gap accordingly, of which one side is narrower than the opposite side with the result that, in operation, due to the narrow grinding gap portion of the mill, grinding stock and also grinding pellets are accumulated there and hindered this way from passing over into a merely tangential movement to the driven mill component, so that the working capacity of the mill is increased accordingly. Another increase in output of the annular gap-type mill is realised according to the invention in that not only the inner body but also the grinding container are supported rotatably and provided with a rotary drive. The sense of rotation of the rotating elements may be opposite or equal. In case of rotating elements moving in the same sense, the speeds or number of rotations are different so as to cause the required relative movement. The rotation of the inner body at the grinding gap inside and of the grinding container at the grinding gap outside ensures that, from two sides, the grinding pellets in the grinding gap are caused to rotate and are activated to work. In such a case, the grinding pellet layer in its total thickness in the grinding gap participates in the grinding operation. If the two mill components are rotating in opposite directions, higher shearing forces of the grinding pellets are caused, and, particularly in the zone of largest diameter, the output may be doubled as compared to the embodiment having one sole driven mill component only. If grinding container and inner body are rotating in the same direction, the behaviour of the grinding pellets in the mill is distinctive in that the separation of the grinding pellets and their prevented discharge from the mill still becomes more effective.

Apart from said increase in output, the simultaneous drive of the inner body and grinding container is also accompanied by another substantial advantage: It is possible to optionally use the mill for wet or dry grinding operations without a necessary conversion.

Should the grinding stock be ground in wet as a slurry, the inner body is driven. Ir the grinding container is allowed to rest, the normal grinding effect is realised, but in case of its drive in the opposite sense, the grinding effect may be increased considerably.

For grinding the stock in dry (in powder form), the grinding container is driven. Should the inner body be left at rest, the normal grinding effect is performed, while, the case of its drive in opposite direction, the grinding output is increased. The simultaneous drive in opposite directions of inner body and grinding container entails another considerable advantage in that, by the increase of speeds of both mill components, the achievable peripheral speeds in the grinding gap are so high that the energy absorbed by the grinding stock particles will ensure their comminution upon their impact in the grinding gap. In other words, grinding pellets need not be used and a material-to-material grinding is taking place (autogeneous grinding). This may play an important part if the grinding pellet abrasion involves a contamination of the grinding stock. Also in case of an autogenous grinding, the output of the mill may be still increased by a unilateral grinding gap constriction.

In view of an adaption of the mill to the material to be ground and to the desired fineness, it is possible to adjust and coordinate a number of parameters.

Preferably, an automatic interval control system is provided for the inner body and the grinding container to first allow them to rotate in the same direction, and, upon reaching the maximum speed, to cause the inner body or grinding container to be displaced relative to each other until a unilateral grinding gap of about 1 mm is obtained, while one of the rotating components is changed over to countersense rotation, the displaced part being returned in the same sense of rotation into its initial position and the operations being repeated.

The inner face of the grinding container and the outer surface of the inner body are of a finely rough nature, i.e. they should not be very smooth or very rough. The condition of fine roughness may be realised by a suitable coating of the surfaces in the form of a corrosion- and wear-resistant later. To exclude a heat accumulation, the grinding container may be surrounded by a coolant jacket or it may be cooled by air.

Figure 2:
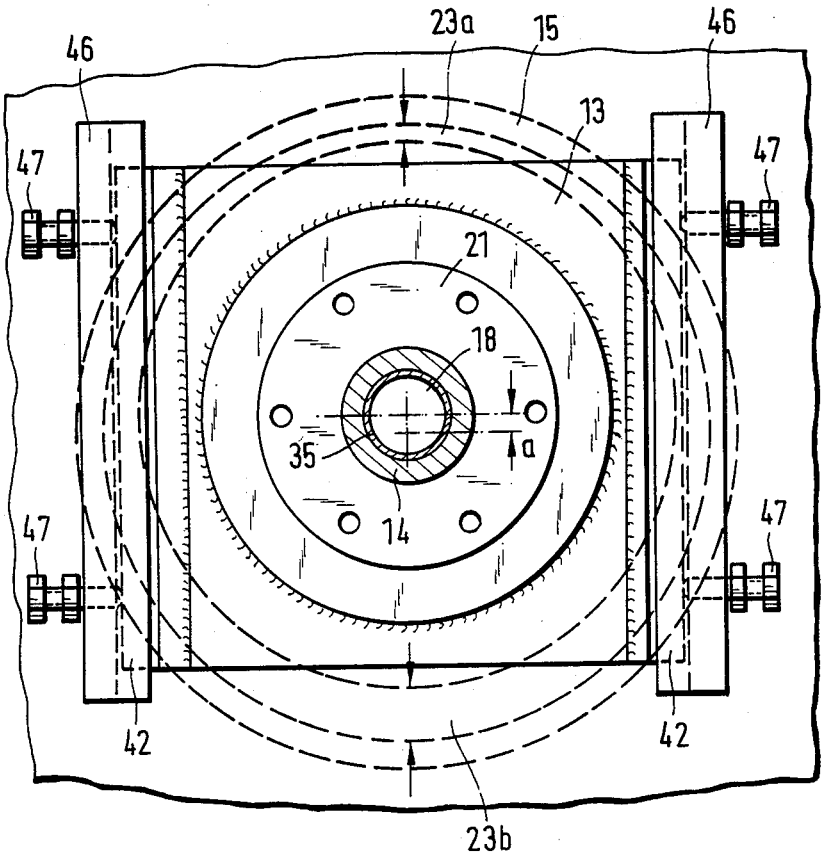
Figure 3:
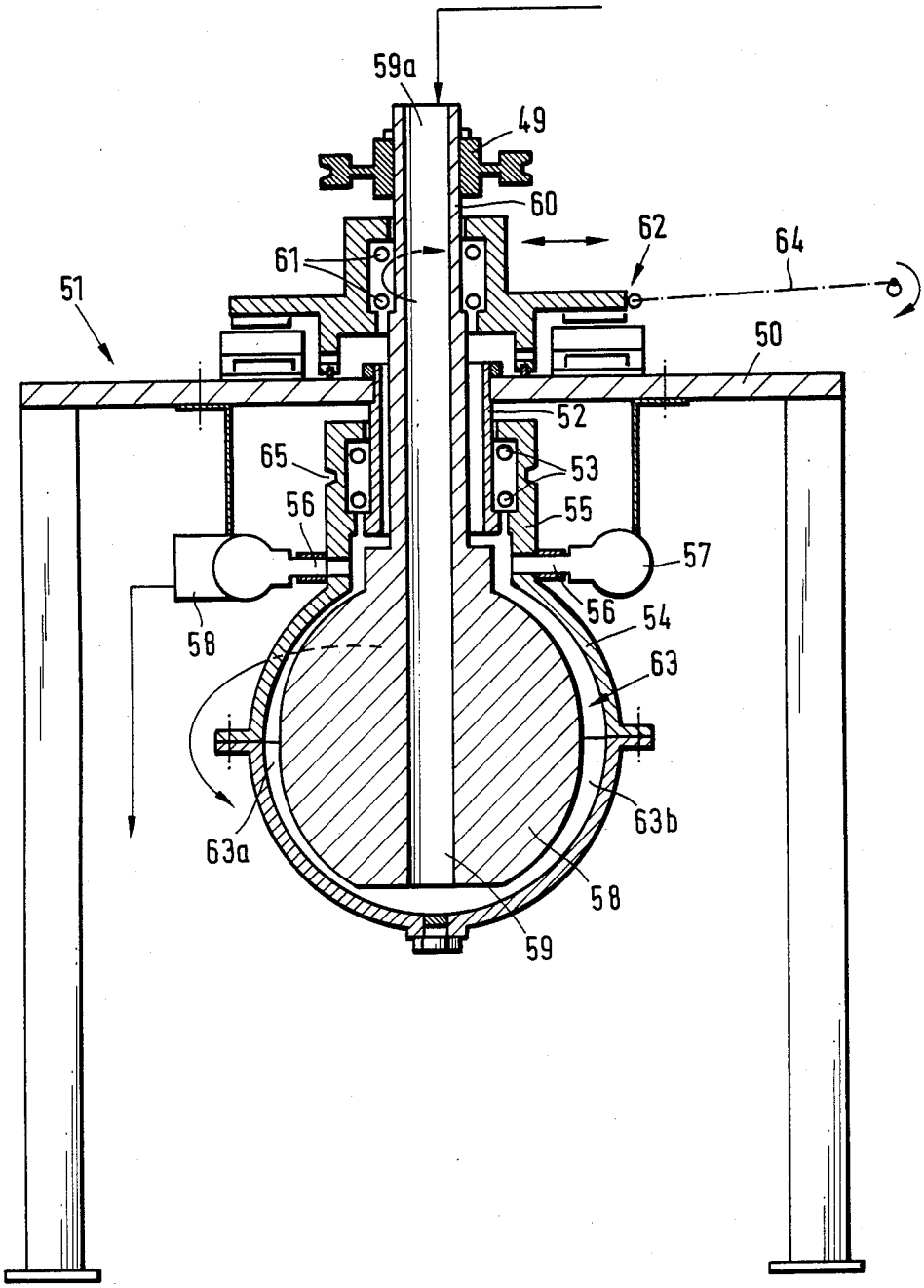
Figure 4:
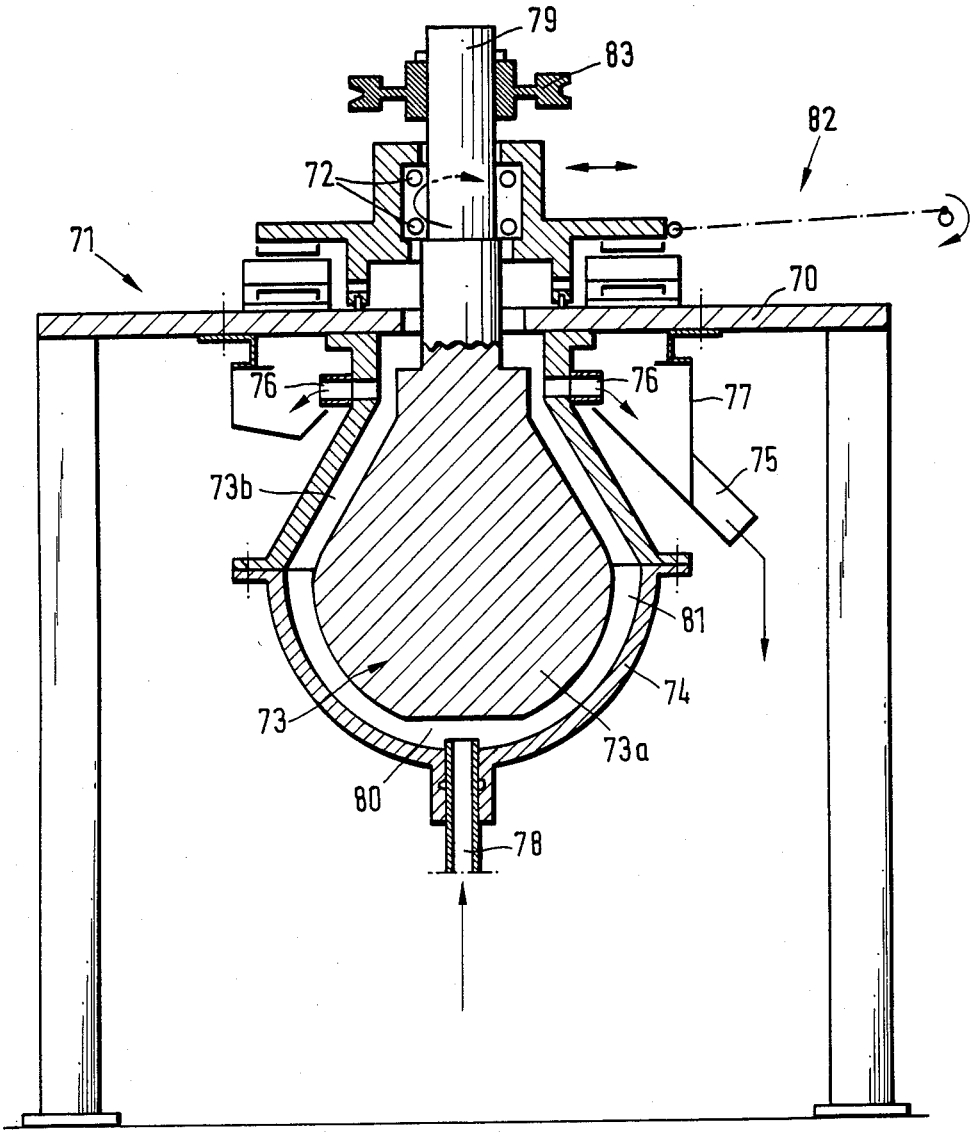
Figure 5:
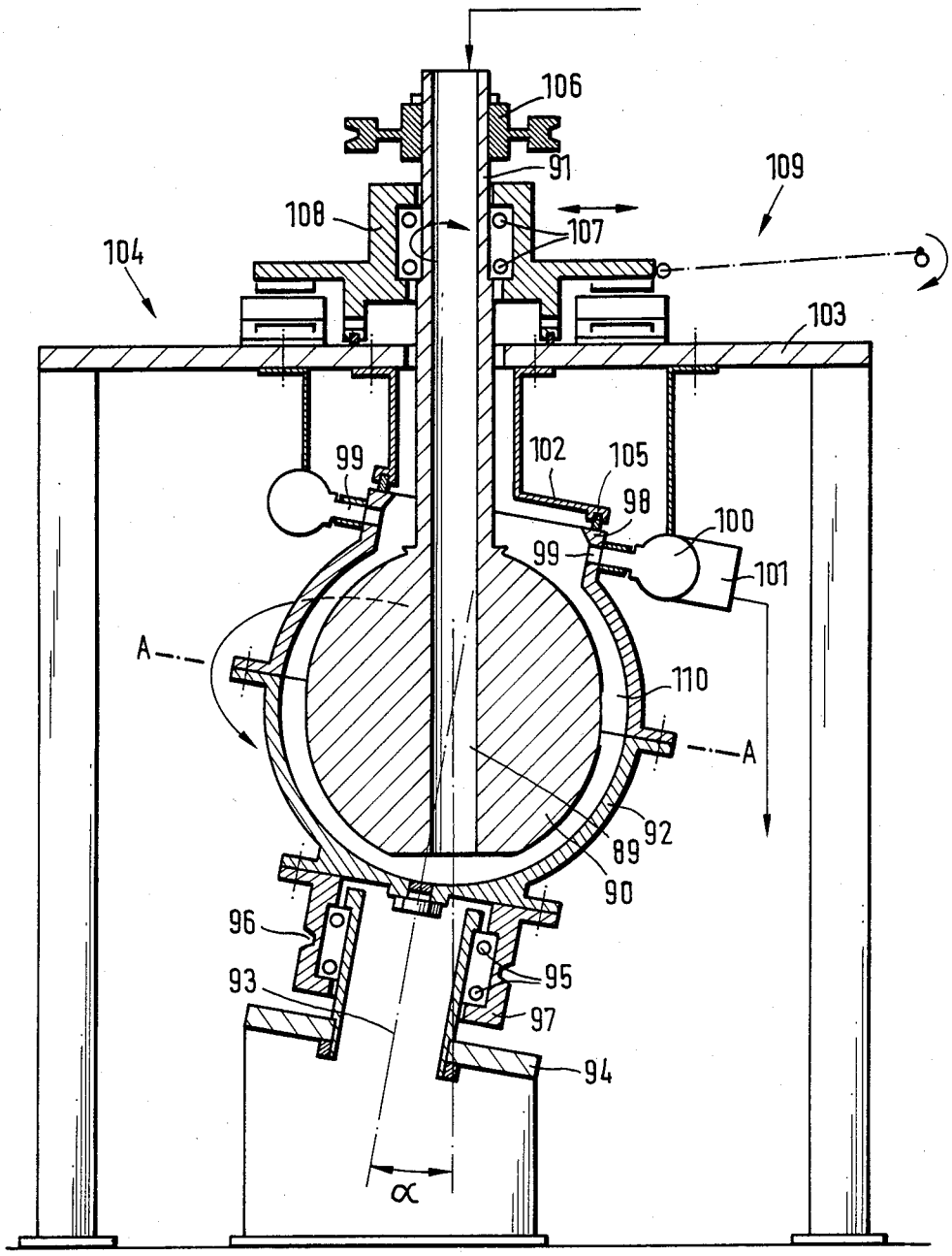
Figure 6:
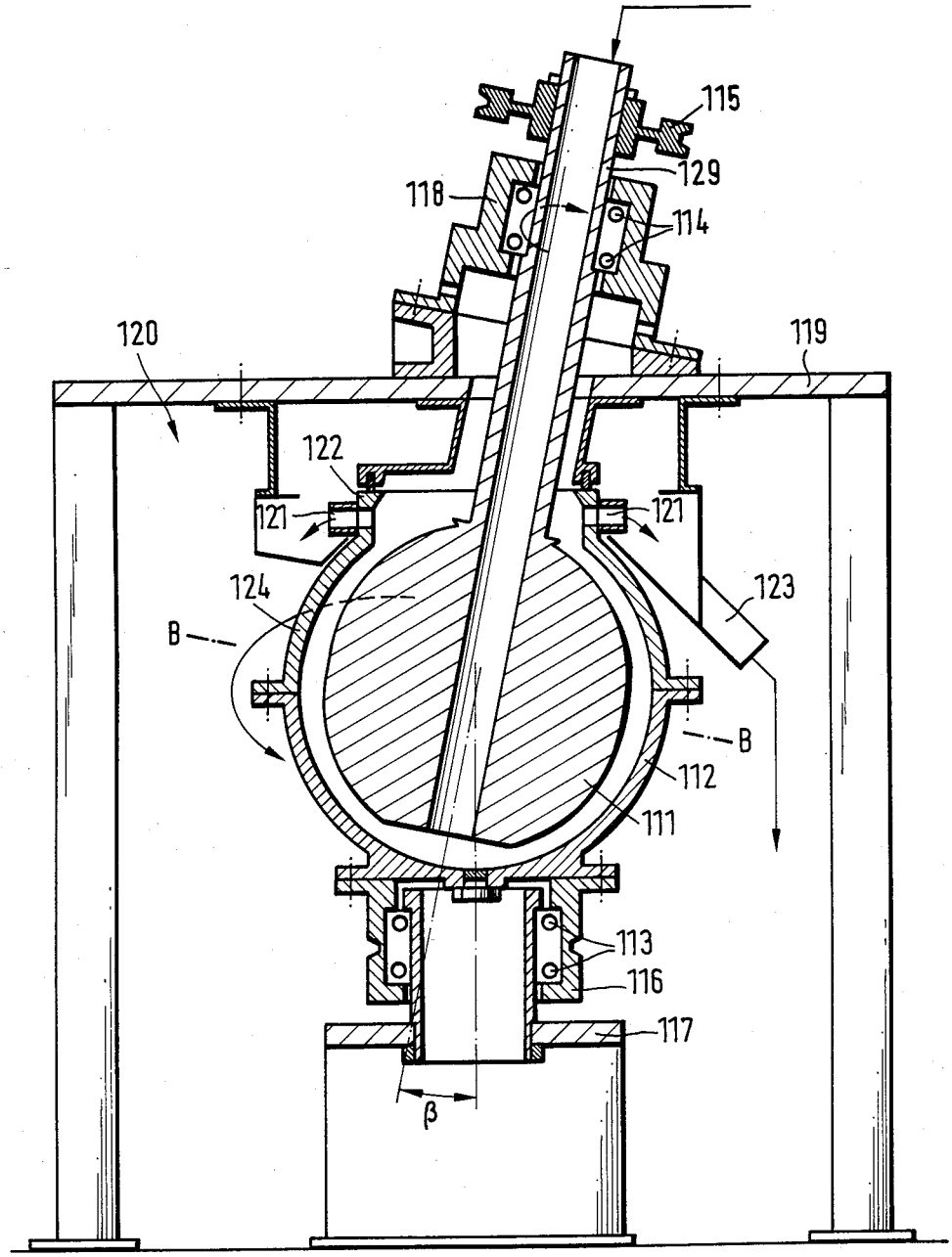
Figure 7:
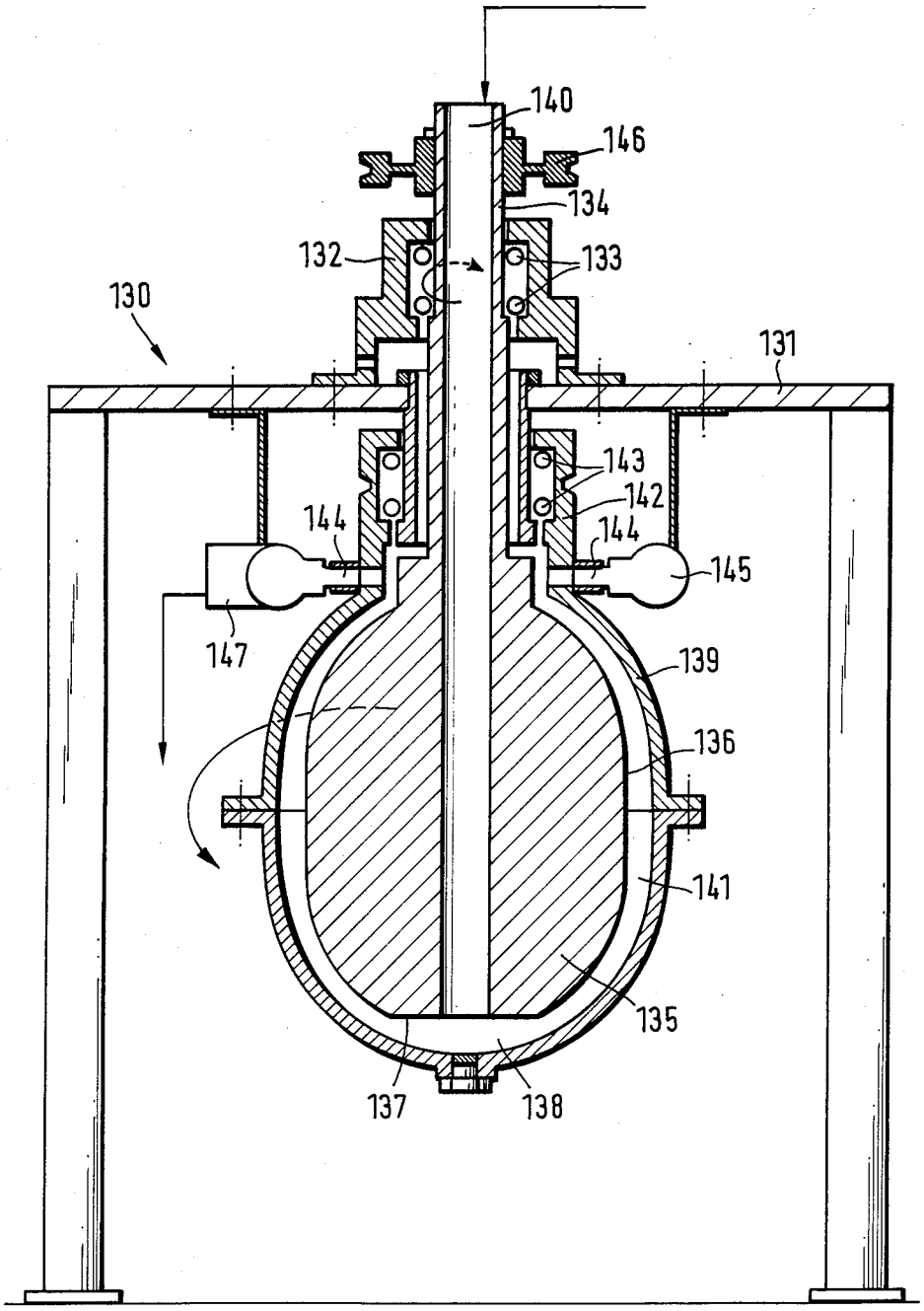

With reference to the drawing, some embodiments of the invention will be explained hereunder in more detail:

FIG. 1 is a longitudinal section of an embodiment of an annular gap-type mill suitable for wet or dry grinding, comprising a driven grinding container and a driven inner body displaceable eccentrically, FIG. 2 is a cross section along line II—II of FIG. 1, FIG. 3 is a longitudinal section of an annular gap-type mill according to FIG. 1, however, with an inner body displaced eccentrically relative to the central axis of the grinding container, FIG. 4 is a longitudinal section of a modified annular gap-type mill for wet grinding, with stationary grinding container, FIG. 5 is a longitudinal section of an annular gap-type mill for dry or wet grinding, with a central axis of the rotatable grinding container inclined relative to the axis of rotation of the inner body, the grinding container drive being effected from below, FIG. 6 is a longitudinal section of an annular gap-type mill in accordance with FIG. 5, however, the axis of rotation of the inner body being inclined relative to the central axis of the rotatable grinding container, and FIG. 7 is another embodiment of an annular gap-type mill for dry and wet grinding, with nearly elliptically formed outer surface of the inner body and inner face of the grinding container.

In an optional support 10, an annular gap-type mill 12 for wet or dry grinding is suspended at a support plate 11, said mill substantially consisting of a driven hollow inner body 13 having a mainly spherical shape and an axis of rotation extending vertically upwardly in the form of a hollow shaft 14, and of an outer grinding container 15 whose inner face is spherical and which is independently rotatable about its central axis being coaxial to the hollow shaft of the inner body 13. Due to the removal of a spherical segment of the ball, the lower end marked with 17 of the inner body 13 is flat. A straight passage 18 of the tubular hollow shaft 14 ends in said flat region 17, the lower end 19 of the hollow shaft being screwed into an internal thread bore of a fitting piece 20 in the inner body 13 and its upper end having an inlet aperture 18*a* and carrying a driving pulley 48. The hollow shaft 14 is supported by a double bearing 16 whose bearing casing 21 is integrally connected to an adjusting means 22 whose purpose and design will be explained hereunder in more detail.

Between the spherical inner face of the grinding container 15 and the outer surface of the nearly spherical inner body 13, there is a ball cup-shaped grinding gap 23 of unequal width and of a symmetrical shape in the upper and lower region. By flattening the inner body 13 in its equatorial zone 24 of maximum diameter but by maintaining a complete spherical shape at the inner face of the grinding container 15, a partial enlargement of the grinding gap 23 is performed in the equatorial zone which changes upwardly and downwardly into grinding gap portions becoming gradually narrower. The lower narrower grinding gap portion ends, due to the flattening 17 of the inner body 13 in an enlarged chamber 25 of passage 18 of the hollow shaft 14, while the upper grinding gap portions is open towards a crown of radial outlet openings 26 inclined peripherally and situated in a cylindrical driving housing 27 firmly connected to the grinding container 15 to cause its rotation if a belt placed into a groove 32 transmits the driving force to the driving housing 27. The outlet openings 26 are radial and inclined in the same sense, their inner shaft-near end being confronted with a cylindrical attachment 28 of the inner body 13 which is covered by a plate 29 and which reinforces the exit of the hollow shaft 14 out of the inner body 13.

At a distance 30*a*, the hollow shaft 14 is surrounded by a bushing 30 whose upper end projecting through support plate 11 is clamped to the latter by a secured nut 41, and which comprises on its outer circumference the inner races of a double ball bearing 31 which pivotally supports driving housing 27 of the grinding container 15. The driving housing 27 rotating with grinding container 15, outlet openings 26 are rotating as well thus throwing the upwardly fed pulverized grinding stock from the grinding gap 23 radially to the outside into a box 33 from which it flows through a downwardly directed collecting channel 34 into a recipient. Due to the centrifugal force, the grinding pellets are retained in the equatorial zone 24 and kept off the discharged product. Without a special control, the grinding pellets are withheld at the desired point and, as a result of the opposite taper of the mill, there is no zone free from grinding pellets through which particles may pass without being ground. Speed (shearing gradient), rotation direction and flow rate are independently adjustable parameters in all embodiments and allow to further optimize the grinding output.

The inner body 13 including its cylindrical attachment 28 and the passage 18 of the hollow shaft 14 are equipped with a corrosion- and wear-resistant protective layer 35 provided preferably with a finely rough surface. This is also applicable to the inner face of the grinding container 15 also having such a finely rough lining 36 extending as far as to the zone of the outlet openings 26 at the inner face of the driving housing 27. The grinding container 15 is centrally divided in a horizontal plane. The upper and lower half of the grinding container 15 are screwed together by fitting flanges 37, 38. In the orifice region 25 in the center of the lower half of the grinding container 15, there is an opening 39 adapted to be closed by a screw cap 40 and to serve as an outlet, for instance for a cleaning fluid.

The annular gap-type mill shown in FIG. 1 may operate with an inner body 13 positioned centrally in the grinding container 15. However, it may be advisable, in view of a pulverization of particular hard substances, to place the inner body 13 eccentrically in the grinding container 15, in other words, to displace it coaxially or preferably transversely to its hollow shaft 14. Such a transverse displacement of the inner body 13 is possible within the range of oversize 30*a* of the bore of bushing 30 relative to the external diameter of the hollow shaft 14. The mentioned adjusting means 22 of which a plan view is illustrated in FIG. 2 is used to this purpose and substantially consists of a double-track slide 42 having a dovetail profile and being connected via a mounting 43 to the bearing casing 21 of the ball bearing 16 clamped by bushings intermediate an annular shoulder 44 on the hollow shaft 14 and a secured nut 45 screwed on an outer thread on hollow shaft 14. The two parallel side portions of slide 42 are displaceable in one corresponding parallel guide 46 fixed to the support plate 11. The position of the slide 42 in the parallel guide system 46 is ensured by transverse thread bolts 47 (FIG. 2) engaging through parallel guide 46 the inclined profile of each side portion of slide 42. Due to the displacement of the inner body 13 effected by the adjusting means 22 in transverse direction to the axis of rotation, the vertical central axis of the inner body 13 is transversely shifted relative to the central axis of the grinding container 15 by a distance a shown in FIG. 2, thus imparting a constriction 23*a* to one side of the grinding gap 23, while its opposite side shows an enlargement 23*b*. Upon rotation of the inner body 13, and of the grinding container 15, the grinding stock introduced with grinding pellets through the upper coaxial opening 18*a* of passage 18 into the orifice chamber 25 and into the grinding gap 23 is accumulated in the constriction 23*a* which, in practice, may be as broad as about 1 mm. The grinding stock which by the grinding pellets is urged through said constriction 23*a* is pulverized still more intensely. The efficiency of the grinding operation further may be nearly doubled if the inner body 13 and the grinding container 15 are rotated in opposite directions thus causing an increase of shearing forces of the grinding stock and of the grinding pellets.

FIG. 3 shows a schematic view of an annular gap-type mill for dry grinding, the basic operating principle corresponding substantially to that of FIG. 1. A cylindrical bushing 52 secured to support plate 50 of frame 51 is designed to suspend rotatably, via a double ball bearing 53, a grinding container 54 having an exactly spherical inner face, the grinding container being firmly joined to a driving housing 55 provided with a peripheral groove 65 for a drive belt. Said driving housing 55 contains a crown of radial outlet apertures 56 ending in an annular suction channel 57 which has a tangential outlet 58 through which the dry pulverized stock is discharged as shown by the arrow. The grinding container 54 is divided horizontally so that, upon its opening, a nearly spherical inner body 58 may be introduced from below into the cavity. The inner body 58 is provided with a coaxial passage 59 changing over into a coaxial hollow shaft 60 having at its upper end an inlet 59*a* for the introduction of grinding stock and grinding pellets. By a drive pulley 49 at its upper end, the hollow shaft 60 may be connected to a drive rotating the inner body 58 in direction of the arrow drafted within the range of a double bearing 61, the arrow pointing to a direction opposite to the indicated sense of rotation of grinding container 54.

Due to an adjusting means 62, the inner body 58 may be displaced radially relative to the inner space of the grinding container 54 so that it is shifted eccentrically relative to the vertical central axis of the grinding container 54, the grinding gap 63 on the left side in the drawing (63*a*) being narrower than that on its right side (63*b*). The adjusting means 62 may contain a usual spindle drive 64 which permits a millimeter setting of the inner body 58 during the rotation of the elements, if necessary, i.e. during the operation of the annular gap-type mill. Otherwise, the configuration of the inner body 58 and of the grinding container 54 with the associated constructional elements substantially corresponds to the embodiment of FIG. 1.

The embodidment of FIG. 4 is distinctive over that of FIGS. 1 and 3, in that the grinding container 74 is non-rotatingly connected to a support plate 70 of a frame 71 so that only the inner body 73 supported by a double ball bearing 72 is rotated. In this annular gap-type mill, only one rotating element may be used because—as evident from the discharge channel 75 and from box 77 surrounding the radial outlet openings 76—it is preferably employed for wet grinding, i.e. for processing slurry. The inner body 73 is nearly pear-shaped, its lower portion 73*a* being curved spherically convexly while its upper region 73*b* may be spahed conically or slightly concavely. The upper region 73*b* of the inner body 73 is continued by a shaft 79 having no passage and whose end extends through the support plate 70 and is pivotally supported in a ball bearing 72. By a drive pullet 83 at the upper end of shaft 79, the inner body 73 is caused to rotate in direction of the arrow. The lower region of the inner face of the grinding container 74 is also nearly spherical, its upper region being substantially adapted to the tapered inner body 73. Between both elements, a grinding gap 81 is left, which, in the equatorial zone, may be broadened so that the centrifugal force in this region is intensified and the retention of the grinding pellets away from the outlet openings 76 is improved. This purpose may be supported by a concave curvature to be provided, if necessary, in the upper region of the inner body 73 and of the grinding container 74. A passage 78 for feeding slurry and grinding pellets is situated centrally in the lower apex zone of the grinding gap 81, said passage 78 being open towards an orifice chamber 80 formed between a flat portion of the inner body 73 and the spherical inner face of the grinding container 74. The vertical inner body 73 is radially displaceable relative to the central axis of the grinding container 74. To this effect, an adjusting means 82 may be used that may correspond to the adjusting means 62 of the embodiment of FIG. 3.

The embodiment of FIG. 5 is different from the preceding embodiments in that a nearly spherical inner body 90 with vertical hollow shaft 91 is combined with a grinding container 92 spherically shaped at least internally and whose central axis 93 is inclined at an angle $\alpha$ relative to the vertical central axis of hollow shaft 91. The grinding container 92 is pivotally supported on an oblique base 94 by means of a double ball bearing 95, the rotary drive being transferred by a belt in a groove 96 of a driving housing 97. The rotation of the grinding container 92 with spherical inner face shall be performed in direction of the arrow assigned thereto. A cylindrical neck portion 98 of the grinding container 92 contains a crown of radial outlet openings 99 which ensure the feeding into a suction channel 100 having a tangential outlet 101. The oblique neck portion 98 has a relatively large clear diameter covered by a stationary oblique cover 102 suspendingly secured to a support plate 103 of a frame 104. Between the underside of cover 102 and the end face of the neck portion 98, there is seated a slide ring seal 105. By a driving belt engaging at the upper end of hollow shaft 91 a driving pullet 106, the inner body 90 is caused to rotate in the direction of the arrow and oppositely to the grinding container 92. The hollow shaft 91 is supported by a double ball bearing 107 situated in a bearing casing 108 that is connected to an adjusting means 109 which permits an eccentric displacement of the inner body 90 in a transverse direction to its axis of rotation in the spherical cavity of the inclined grinding container 92 so that one side of the grinding gap 110 will be narrower than the opposite side. Since the grinding container 92 is inclined by angle $\alpha$ relative to the vertical, the outlet openings 99 situated in a plane parallel to the transverse plane A—A of the grinding container 92 consist of higher and lower portions. Since, in case of operation of the mill, the mass-rich particles, i.e. as a rule, the grinding pellets move on an orbit which is at right angles to the central axis of the driven mill element (inner body 90 or grinding container 92), the outlet for the ground stock may be shifted to the highest or the lowest position of the grinding gap 110, subject to the inclination of the inner body 90 or the grinding container 92. Such a distance of the material outlet to the most operative equatorial zone of the driven mill element additionally contributes to avoid discharging of grinding pellets. The pulverized grinding stock is moved upwardly more or less slowly, subject to the feeding pressure by which, inside the hollow shaft 91, it is urged into the grinding gap 110, and it escapes free of grinding pellets into the suction channel 100. The effect improved by the inclination of the grinding container with respect to the reduced amount of grinding pellets drifting away is also realised if the grinding container is at rest.

FIG. 6 shows an annular gap-type mill in which the axis of rotation of an inner body 111 also forms an angle $\beta$ with the central axis of a rotatable grinding container 112. However, in this embodiment, the grinding container 112 is positioned vertically and the inner body 111 is inclined. Each of them is rotating in double ball bearings 113 and 114. Their drives are transmitted by motors which, via belts, engage a driving pullet 115 at the upper end of a hollow shaft 129 of the inner body 111 and via a driving gear 116, the grinding container 112 which is mounted vertically on a straight base 177, while the inner body 111 is arranged to be suspended obliquely in an inclined bearing casing 118 that is provided on a support plate 119 of a frame 120. A crown of radial outlet openings 121 surrounding a cylindrical neck portion 122 of the grinding container 112 ensures that the milled slurry obtained in the wet grinding process is discharged through a collecting channel 123 which extends into a container. Also in this case, the discharge of grinding pellelts from the grinding gap 94 is excluded more satisfactorily because, relative to the effective equatorial zone B—B of the inner body 111 inclined to the vertical line, and in which the highest centrifugal forces prevail, the outlet openings 121 are divided into a lower left-hand portion and a higher right-hand portion which practically are not reached by the grinding pellets.

FIG. 7 shows an annular gap-type mill in which a bearing casing 132 for the double ball bearing 133 of a vertical hollow shaft 134 of an inner body 135 is mounted on a support plate 131 of a frame 130. The shape of the inner body 135 is nearly elliptical with a slight flattening 136 in the equatorial zone of maximum diameter. The lower section of the elliptic inner body 135 is flat near 137 thus forming an orifice chamber 138 between the flattening 137 and the vault of the completely elliptic inner face of a grinding container 139. In the orifice chamber 138 ends the straight passage 140 of hollow shaft 134 through which dry material to be ground as well as the grinding pellets are fed from above. Between the outer face of inner body 135 and the inner face of the grinding container 139, there is a grinding gap 141 being contracted uniformly in upward and downward direction. The grinding container 139 is firmly connected to a driving housing 142 accomodating a double ball bearing 143 and transmitting the drive of a motor to the grinding container 139 which rotates independently of the inner body 135, the axes of rotation of both rotating elements being provided coaxially. Through a crown of radial outlet openings 144, the pulverized stock gets into a suction channel 145. A driving disk 146 at the upper end of hollow shaft 134 is adapted to transmit the drive of a motor to the inner body 135.

The embodiments of FIGS. 1 to 7 only are examples whose constructional elements are interchangeable, thus permitting to dispose of annular gap-type mills for wet or dry grinding hard substances of different kinds by operating with rotatable or stationary grinding containers or inner bodies and with the use of grinding gaps contracted unilaterally or being dimensioned uniformly. The inner body and grinding container speeds as well as the directions of rotation can be adapted to the kind of material to be ground, and may be equal or different. By the use of an automatic interval control system, it is possible, to first drive the grinding container and the inner body in the same sense, thereafter, upon reaching the maximum speed, to displace relative to each other the inner body or the grinding container until a unilateral grinding gap of about 1 mm is obtained, then, to simultaneously change the driving sense of the grinding container or the inner body, whereupon the grinding container or inner body is returned to its initial position with the same sense of rotation and the operations will be repeated.

What is claimed is:

1. Annular gap-type mill for continuously pulverizing in particular hard mineral substances comprising an outer grinding container having an inner surface, said grinding container accommodating a coaxial, symmetric inner body whose outer surface defines, with the inner surface of the grinding container, a grinding gap, said inner body having an upper region and a lower region, wherein the upper and lower region of the inner body are tapered in opposite directions and adjoined to a common equatorial zone of maximum diameter, the outer surface of at least one of the regions being curved convexly.

2. Annular gap-type mill according to claim 1, wherein a portion of the outer surface of the upper region of the inner body is curved concavely.

3. Annular gap-type mill according to claim 1, wherein the outer surface of the inner body is curved spherically in a closed line.

4. Annular gap-type mill according to claim 1, wherein the outer surface of the inner body is curved elliptically in a closed line.

5. Annular gap-type mill according to claim 1, wherein the radii of curvatures of the outer surface of the inner body and of the inner surface of the grinding container are different.

6. Annular gap-type mill according to claim 1 further comprising an inlet for the grinding stock, wherein the inner body comprises a central passage communicating with the inlet for the grinding stock and is open-ended in the lower region of the grinding gap while an outlet is provided in the upper region of the grinding container.

7. Annular gap-type mill according to claim 1, wherein the central axis of the inner body is inclined relative to the central axis of the grinding container.

8. Annular gap-type mill according to claim 1, wherein both the central axis of the inner body and the central axis of the grinding container are inclined relative to the vertical.

9. Annular gap-type mill according to claim 1, wherein both the inner body and the grinding container are displaceably positioned in view of a change of the grinding gap width.

10. Annular gap-type mill according to claim 9, wherein the displacement in position may be effected during the rotation of the inner body.

11. Annular gap-type mill according to claim 9, wherein the displacement in position may be effected during the rotation of the grinding container.

12. Annular gap-type mill according to claim 1, wherein the grinding container and the inner body are supported pivotally and connected to a rotary drive.

13. Annular gap-type mill according to claim 12 including the provision of an automatic interval switch system for the inner body and the grinding container for changing the sense of rotation of the inner body to effect the relative displacement of the inner body and the grinding container.

14. Annular gap-type mill according to claim 12 including the provision of an automatic interval switch system for the inner body and the grinding container to effect the relative displacement of the inner body and the grinding container.

15. Annular gap-type mill according to claim 12, wherein the inner body and the grinding container are driven in opposite directions.

16. Annular gap-type mill according to claim 12, wherein the inner body and the grinding container are driven in the same direction.

17. Annular gap-type mill according to claim 12, wherein the displacement in position may be effected during the rotation of the inner body and the grinding container.

18. Annular gap-type mill according to claim 12 including the provision of an automatic interval switch system for the inner body and the grinding container for changing the sense of rotation of both the inner body and the grinding container, to effect the relative displacement of the inner body and the grinding container.

19. Annular gap-type mill according to claim 18, wherein the automatic interval switch system operates such that the grinding container and the inner body and first allowed to move in the same sense of rotation, and, upon reaching the maximum speed, the inner body and the grinding container are displaced relative to each other until a unilateral grinding gap of about 1 mm is obtained, whereupon the inner body is changed over to counterrotation, the inner body being subsequently returned to the initial position and in the same sense of rotation and said operations being thereafter repeated.

20. Annular gap-type mill according to claim 18, wherein the automatic interval switch system operates such that the grinding container and the inner body are first allowed to move in the same sense of rotation, and, upon reaching the maximum speed, the inner body and the grinding container are displaced relative to each other until a unilateral grinding gap of about 1 mm is obtained, whereupon the grinding container is changed over to counter-rotation, the grinding container being subsequently returned to the initial position and in the same sense of rotation and said operations being thereafter repeated.

21. Annular gap-type mill according to claim 1, wherein the grinding container comprises a central passage communicating with the inlet for the grinding stock and is open-ended in the lower region of the grinding gap while an outlet is provided in the upper region of the grinding container.

22. Annular gap-type mill according to claim 1, wherein the central axis of the inner body is inclined relative to the vertical.

23. Annular gap-type mill according to claim 1, wherein the central axis of the grinding container is inclined relative to the vertical.

24. Annular gap-type mill according to claim 1, wherein the inner body is displaceably positioned in view of a change of the grinding gap width.

25. Annular gap-type mill according to claim 1, wherein the grinding container is displaceably positioned in view of a change of the grinding gap width.

26. Annular gap-type mill according to claim 1, wherein the grinding container is supported pivotally and connected to a rotary drive.

27. Annular gap-type mill according to claim 1, wherein the inner body is supported pivotally and connected to a rotary drive.

* * * * *